US010088134B1

(12) United States Patent
Helms et al.

(10) Patent No.: US 10,088,134 B1
(45) Date of Patent: Oct. 2, 2018

(54) ADJUSTABLE PLATE FOR USE WITH A MOUNT

(71) Applicant: Clarolux, Inc., Greensboro, NC (US)

(72) Inventors: Brandon L. Helms, Cornelius, NC (US); Robert G. Groat, Greensboro, NC (US)

(73) Assignee: Claralux, Inc., Greensboro, NC (US)

( * ) Notice: Subject to any disclaimer, the term of this patent is extended or adjusted under 35 U.S.C. 154(b) by 7 days.

(21) Appl. No.: 15/138,273

(22) Filed: Apr. 26, 2016

Related U.S. Application Data

(60) Provisional application No. 62/153,750, filed on Apr. 28, 2015.

(51) Int. Cl.

| | |
|---|---|
| ***F21S 13/02*** | (2006.01) |
| ***F21V 19/02*** | (2006.01) |
| ***F21V 21/00*** | (2006.01) |
| ***F21V 33/00*** | (2006.01) |
| ***F21V 19/00*** | (2006.01) |

(52) U.S. Cl.
CPC ..... *F21V 19/02* (2013.01); *F21V 19/007* (2013.01); *F21V 21/00* (2013.01); *F21V 33/006* (2013.01)

(58) Field of Classification Search
CPC ..... F21V 21/00; F21V 21/30
USPC ..... 362/432, 269
See application file for complete search history.

(56) References Cited

U.S. PATENT DOCUMENTS 4,039,821 A * 8/1977 Greene ..... F21V 21/02 362/217.08
7,832,889 B1 * 11/2010 Cogliano ..... F21S 8/02 362/147

* cited by examiner

*Primary Examiner* — Sean Gramling
(74) *Attorney, Agent, or Firm* — MacCord Mason PLLC

(57) ABSTRACT

Mounting system, assemblies, and methods are shown and described. In one embodiment, the mounting system secures a light fixture about a surface in a rotational coupled position. The system may include an adjustable mount and an adjustable plate. The plate may include a central aperture and a plurality of alignment slots to allow the plate to be substantially rotational about said mount in said coupled position.

20 Claims, 9 Drawing Sheets

ADJUSTABLE PLATE FOR USE WITH A MOUNT

This application claims the benefit of U.S. provisional application No. 62/153,750, filed Apr. 28, 2015, which is herein incorporated by reference.

FIELD OF THE TECHNOLOGY

The present disclosure relates generally to fixture supports, and more particularly to improved adjustable mounting systems and methods.

BACKGROUND

Classical mounting systems are rigidly affixed to a surface of a structure (e.g., a building or property) for securing an accessory or fixture to the surface. After the mounting system is mounted to the surface, the accessory or fixture can be secured to the surface by attaching the accessory or fixture to the mounting system. Once secured, the accessory or fixture is often adjusted, for example, to improve accessibility, or to satisfy aesthetic preferences. However, traditional systems often fail to facilitate proper attachment of the accessory, or fixture, to the mounting system. Further, conventional systems fail to facilitate sufficient adjustment of the accessory, or fixture, while the mounting system is mounted to the surface of the structure.

Therefore, Applicant desires systems and methods for adjustable fixture mounting without the drawbacks presented by the traditional systems and methods.

SUMMARY

In accordance with the present disclosure, mounting systems and assemblies are provided for a wide variety of applications to secure a fixture about a surface, and the like. This disclosure provides improved methods and devices that are convenient, efficient, and safe for the user, particularly when used to secure a plate and mount in an adjustable coupled position.

In one embodiment, in a mounting system having a mount secured about a surface and supporting a fixture, an adjustable plate comprises a central aperture receiving the fixture, and wherein the central aperture has a slotted electrical communication opening, and a plurality of alignment slots having an inner area and a pair of opposing distal areas. Typically, the plate aligns between the mount and the light fixture in an adjustable coupled position.

In some examples, the inner area has a diameter greater than a diameter of the distal area. The central aperture may have a plurality of threads, for instance to mate with a plurality of corresponding light fixture threads. The plate may be rotational about the mount in the coupled position.

In another embodiment, a mounting system comprises an adjustable mount with a threaded central aperture and a plurality of mounting slots, the central aperture includes a slotted electrical communication opening; and an adjustable plate including a central aperture having a slotted electrical communication opening, and a plurality of alignment slots having an inner area and a pair of opposing distal areas.

In particular examples, the inner area has a diameter greater than a diameter of the distal area. The mount and plate may mate in a rotational coupled position, and in particular the plate may be rotational about the mount in the coupled position.

Yet another embodiment of disclosure is a mounting system to secure a light fixture about a surface, the system comprises an adjustable mount having a mounting engagement surface and a plurality of mounting slots secured about the surface, and an adjustable plate having a plurality of alignment slots. Typically, the plate is semi, or fully, rotational about the mount in the coupled position.

In some examples, the adjustable mount includes a central aperture to receive the light fixture. The central aperture may be a threaded aperture. Further, the central aperture may include a slotted electrical communication opening to align any of the electrical components shown or described herein or understood by one of ordinary skill in the art having the benefit of this disclosure.

In particular examples, the adjustable mount includes a proximate first portion having at least one first end slot. The adjustable mount may include a second portion protruding from the first portion, and wherein the second portion separates the first portion and the mounting engagement surface. The second portion may be aligned substantially parallel with the mounting engagement surface. In some examples, the second portion may have an angled neck that is generally offset with the mounting engagement surface.

In some examples, the mounting engagement surface includes a plurality of second portion slots aligning about the plate. The adjustable plate's alignment slot may include an inner area and at least one adjacent distal area. Further, the inner area may have a diameter greater than a diameter of the distal area.

In particular examples, the system may include a light fixture. Further, in certain examples the system may include a structure surface, i.e. any of the surfaces or adjacent bodies shown and described herein or understood by those skilled in the art having the benefit of this disclosure, for supporting any of the systems and assemblies herein.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
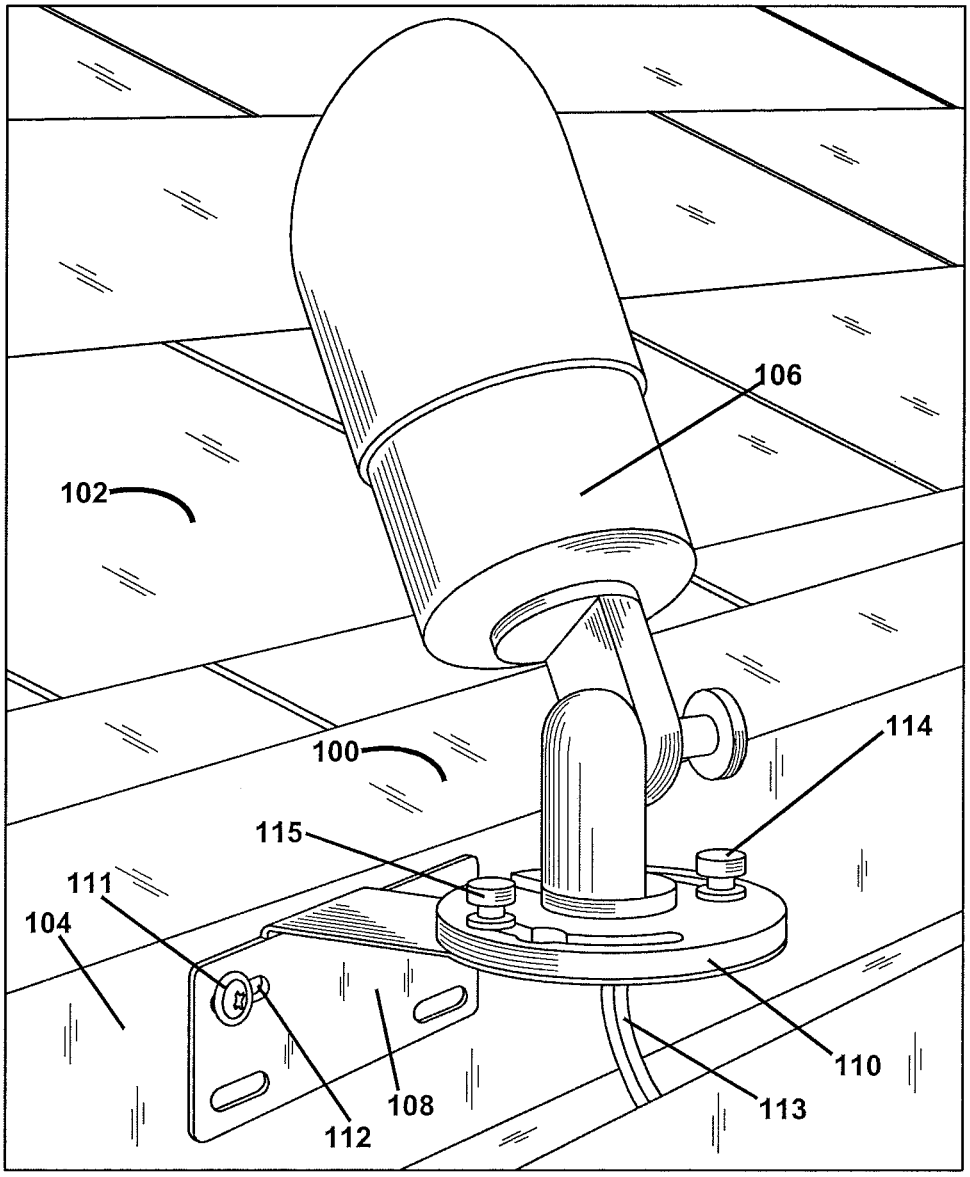
FIG. 1 is a side perspective view of one embodiment of a mounting system according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1A:
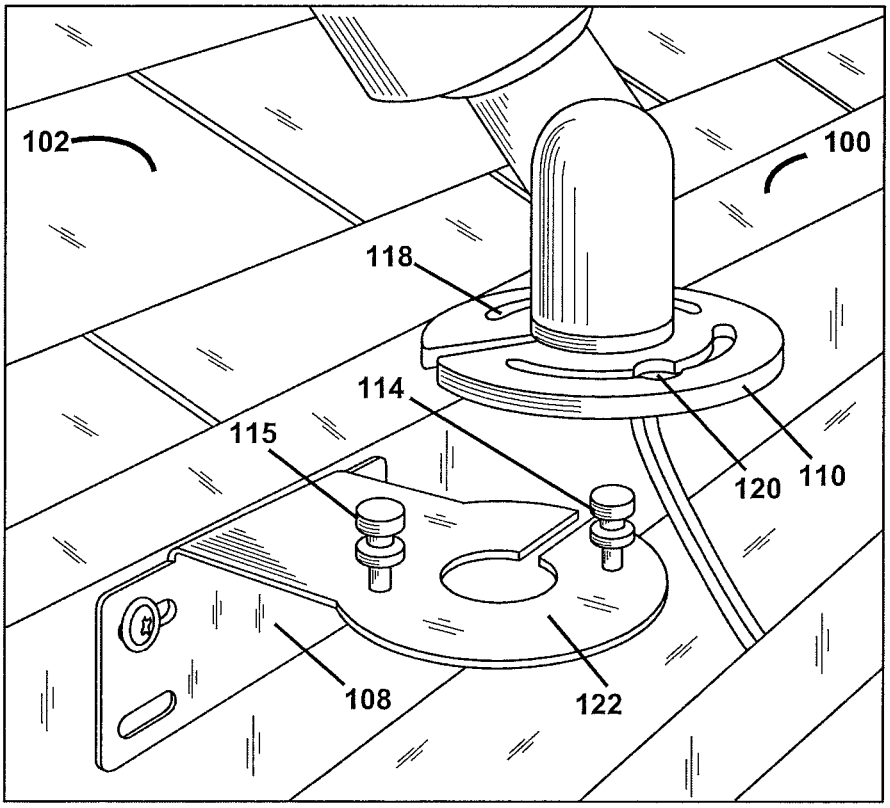
FIG. 1A is another side perspective view of the mounting system introduced in FIG. 1 in one example of an uncoupled position.

Referring now to the drawings in general and FIGS. 1 and 1A in particular, it will be understood that the illustrations are for the purpose of describing embodiments of the disclosure and are not intended to limit the disclosure or any inventions thereto. As best seen in FIG. 1, mounting system 100 and assemblies are shown embodied according to the present disclosure to secure a fixture to a surface, wherein the system's mount 108 and plate 110 are adjustable in the coupled position. Those skilled in the art having the benefit of this disclosure will recognize the surface may be a surface of a structure, including, but not limited to, a building, a property, a fascia, board, a rain gutter, a deck, a dock, a patio, a tree, an arbor, and the like.

As shown in FIGS. 1 and 1A, the mounting system 100 can include a mount 108 and an adjustable plate 110. The mount 108 may be any device that can be used to mount the mounting system 100 to the surface 104 of the structure 102. In some examples, the mount 108 can be configured for receiving a fastener for mounting the mounting system 100 to the surface 104. In some examples, the mount 108 may receive the fasteners via a slot in the mount 108. For example, the mount 108 may receive a fastener 111 via a slot 112 in the mount 108. The fastener 111 may be used to engage the mount 108 with the surface 104 for mounting the mounting system 100 to the surface 104. In this example, one fastener is used to engage the mount 108 with the surface 104. In some examples, more than one fastener may be used to engage the mount 108 with the surface 104. The number of fasteners used to engage the mount 108 with the surface 104 may depend on a number of factors including for example, the size of the fixture 106, the weight of the fixture 106, the number of slots in the mount 108, and other factors.

FIG. 1 illustrates a mounting system 100 installed on a structure 102. In this example, the mounting system 100 is depicted for use on a building (e.g., for use on a fascia board for the building or a rain gutter for the building). In other examples, the mounting system 100 may be used with a number of structures including, for example, and without limitation, a deck, a dock, a patio, a tree, an arbor, or other structures. The mounting system 100 can be mounted to a surface 104 of the structure 102. The mounting system 100 may be used to secure a fixture 106 to the surface 104. In other examples, the mounting system 100 may be used to secure the fixture 106 to the structure 102.

The mounting system 100 typically includes a mount 108 and an adjustable plate 110. The mount 108 can be any device that can be used to mount the mounting system 100 to the surface 104 of the structure 102. In some examples, the mount 108 can be configured for receiving a fastener for mounting the mounting system 100 to the surface 104. In some examples, the mount 108 may receive the fasteners via a slot in the mount 108. For example, the mount 108 can receive a fastener 111 via a slot 112 in the mount 108. The fastener 111 can be used to engage the mount 108 with the surface 104 for mounting the mounting system 100 to the surface 104. In this example, one fastener is used to engage the mount 108 with the surface 104. In some examples, more than one fastener can be used to engage the mount 108 with the surface 104. The number of fasteners used to engage the mount 108 with the surface 104 can depend on a number of factors including for example, the size of the fixture 106, the weight of the fixture 106, the number of slots in the mount 108, and other factors.

In this example, the mount 108 is depicted as a bracket configured to engage the mounting system 100 with the surface 104. In other examples, the mount 108 can be any device configured to engage a mounting system with a surface of a structure. The mount 108 can be of any shape, size, or configuration for engaging the mounting system 100 with the surface 104 of the structure. The type of mount used to engage a mounting system with the surface can depend on a number of factors including for example, the type of surface, the location of the surface on the structure, the type of fixture, and other factors.

The adjustable plate 110 can be any device configured to be coupled to the fixture 106. For example, the adjustable plate 110 can include a threaded portion. The threaded portion of the adjustable plate 110 can be configured to engage an externally-threaded end of the fixture 106. Engaging the externally threaded end of the fixture 106 with the threaded portion of the adjustable plate 110 may couple the adjustable plate 110 to the fixture 106. In some examples, the threaded portion of the adjustable plate 110 may also allow an electrical communication, for instance wire 113 (e.g., a wire connected to the fixture 106), to pass through the adjustable plate 110.

The adjustable plate 110 can be configured to be coupled to the mount 108. In some examples, the adjustable plate 110 can include multiple slots for coupling the adjustable plate 110 to the mount 108. For example, fasteners 114, 115 may be mounted on a surface of the mount 108. Each of the fasteners 114, 115 can be any be any device configured to engage on structure or object with another structure or object (e.g., bolts, screws, drills and anchors, etc.) The adjustable plate 110 can include slots configured to receive the fasteners 114, 115. The fasteners 114, 115 can be inserted into the slots on the adjustable plate. The fasteners 114, 115 may be locked in place within the adjustable plate 110 by rotating the fasteners 114, 115. Locking the fasteners 114, 115 within the adjustable plate can couple the adjustable plate 110 to the mount 108. In this example, the adjustable plate 110 is depicted as being positioned on top of the mount 108 and coupled to the mount 108 via fasteners 114, 115 positioned on a top surface of the mount 108. In other examples, the adjustable plate 110 can be positioned on a bottom surface of the mount 108 and coupled to the mount 108 via fasteners. For example, the mount 108 may be inverted to allow the adjustable plate 110 to be positioned on the bottom surface of the mount 108.

In other examples, the adjustable plate 110 can be coupled to the mount using magnets. For example, a magnet may be mounted on a surface of the adjustable plate 110. Another magnet may be mounted on a surface of the mount 108. The adjustable plate 110 can be positioned relative to magnets on the surface of the mount 108 such that attractive magnetic forces generated by the magnets can cause the adjustable plate 110 and the mount 108 to be coupled.

FIG. 1A shows mounting system 100 of FIG. 1 in an uncoupled state. The mounting system 100 includes a mount 108 and an adjustable plate 110. The adjustable plate 110 can be configured to be coupled to the mount 108. For example, the adjustable plate 110 can include slots 118,120. Each of the slots 118, 120 can be configured to receive fasteners. For example, the slots 118,120 can be configured to receive fasteners 114, 115 attached to a surface 122 of the mount 108. The fastener 114 may be inserted into slot 120. The fastener 115 may be inserted into slot 118. The adjustable plate 110 can be coupled to the mount 108 by inserting the fasteners 114 and 115 into the slots 120 and 118, respectively. In some examples, rotating the adjustable plate 110 can lock the fasteners 114, 115 into place within the slots 118, 120 to further couple the adjustable plate 110 to the mount 108. Once the fasteners 114, 115 are locked into place, the fasteners 114, 115 may be rotated to even further couple the adjustable plate 110 to the mount 108.

Figure 1B:
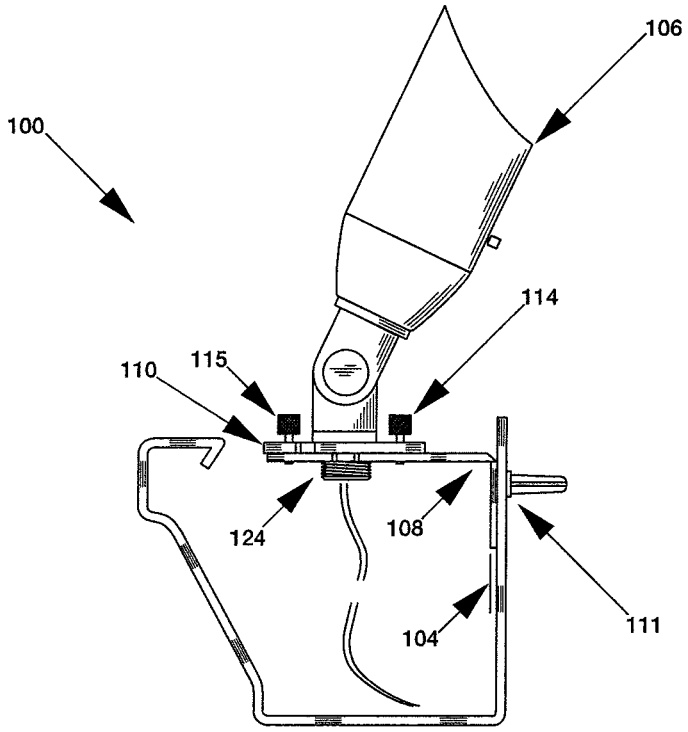
FIG. 1B is side perspective view of the mounting system introduced in FIG. 1.

FIG. 1B is a side view of the mounting system 100 of FIG. 1. A mount 108 can be used to mount the mounting system 100 to a surface 104 of a structure. In this example, a fastener 111 (e.g., a drill and anchor) is used to engage the mount 108 with the surface 104 for mounting the mounting system 100 to the surface 104. The adjustable plate 110 can be coupled to a fixture 106. For example, the adjustable plate 110 can include a threaded portion that is configured to engage with an externally-threaded end 124 of the fixture 106 for coupling the adjustable plate 110 to the fixture 106. The adjustable plate 110, along with the fixture 106, can be coupled to the mount 108 by fasteners 114, 115.

Figure 2:
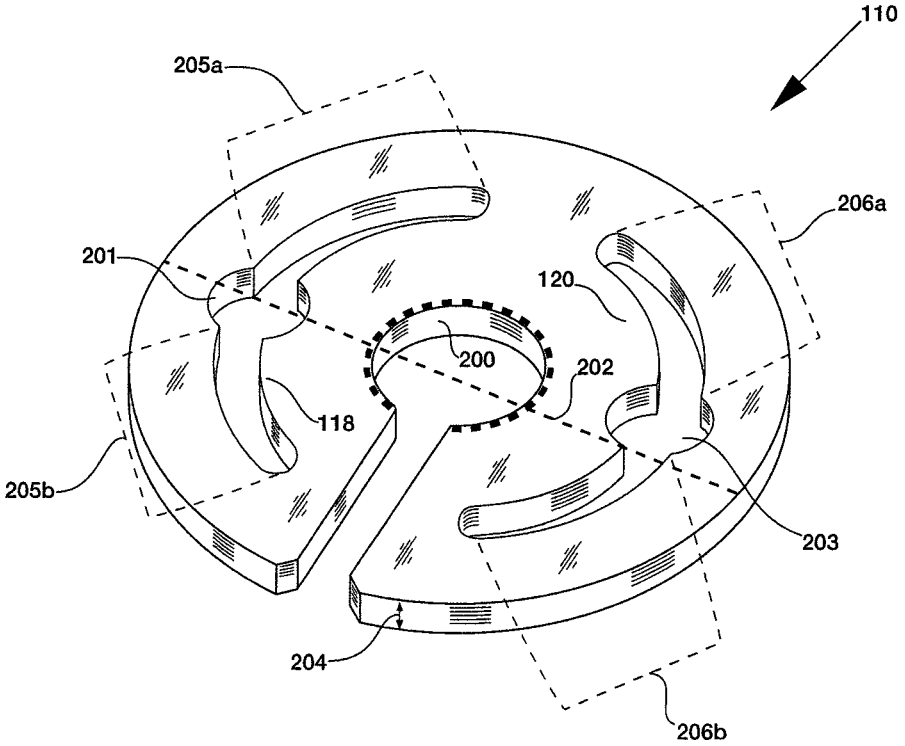
FIG. 2 is a top perspective view of one example of an adjustable plate.

FIG. 2 is a perspective view of an example of an adjustable plate 110 that can be included in a mounting system. In some examples, the adjustable plate 110 can be constructed from a number of materials (e.g., aluminum or other metal). The adjustable plate 110 can have a diameter 202. In some examples, the diameter 202 can be 2.7 inches. The adjustable plate 110 can also have a thickness 204. In some examples, the thickness 204 can be 0.1875 inches.

The adjustable plate 110 can include a threaded portion 200. The threaded portion 200 can be configured to engage with another structure or object having corresponding threads. For example, the threaded portion 200 can be configured to engage with an externally-threaded end of a fixture (e.g., the externally-threaded end 124 of the fixture 106). In some examples, the threaded portion 200 can comprise one-half National Pipe Straight thread. In other examples, the threaded portion 200 may comprise thread of any size configured to engage with another structure or object having corresponding threads. In some examples, a diameter of the threaded portion 200 may allow a wire (e.g., the wire 113 connected to the fixture 106) to pass through the adjustable plate 110.

The adjustable plate 110 can be configured to be coupled to a mount (e.g., the mount 108). For example, the adjustable plate 110 can include slots 118, 120. The slots 118, 120 can be of any size, shape, or configuration. In some examples, the slots 118, 120 can be of substantially the same size, shape, or configuration. The slots 118, 120 may allow the adjustable plate 110 to be coupled to a mount. For example, the slot 118 can include a center portion 201. The slot 120 can include a center portion 203. In some examples, each of the center portions 201, 203 can be configured to have a substantially circular shape. Each of the center portions 201, 203 can be configured to receive an object or structure. For example, each of the center portions 201, 203 may be threaded to receive an object or structure having corresponding threads (e.g., a bolt, screw, etc.). In some examples, a fastener mounted on a surface of the mount (e.g., the fasteners 114, 115) can be inserted into each of the center portions 201, 203. The adjustable plate 110 can be coupled to the mount by inserting the fasteners into the center portions 201, 203. The adjustable plate 110 can be rotated in any direction to lock the fasteners into place within a distal portion of the slots 118, 120. For example, the slot 118 can include distal portions 205*a-b*. The slot 120 can include distal portions 206*a-b*. The adjustable plate 110 can be rotated in any direction to lock the fasteners into place within the distal portions 205*a-b*, 306*a-b*. Locking the fasteners into place within the slots 118, 120 can couple the adjustable plate 110 to the mount. After the fasteners are locked into place, the fasteners may be rotated to even further couple the adjustable plate 110 to the mount. In some examples, a configuration of the slots 118, 120 may allow the adjustable plate 110 to be rotated in any direction while the adjustable plate 110 is coupled to the mount.

In another example, the adjustable plate 110 can be configured to be coupled to the mount by magnets. For example, a magnet may be mounted on a surface of the adjustable plate 110. Another magnet may be mounted on a surface of the mount. The adjustable plate 110 can be positioned relative to magnets on the surface of the mount such that attractive magnetic forces generated by the magnets can cause the adjustable plate 110 and the mount to be coupled.

Figure 2A:
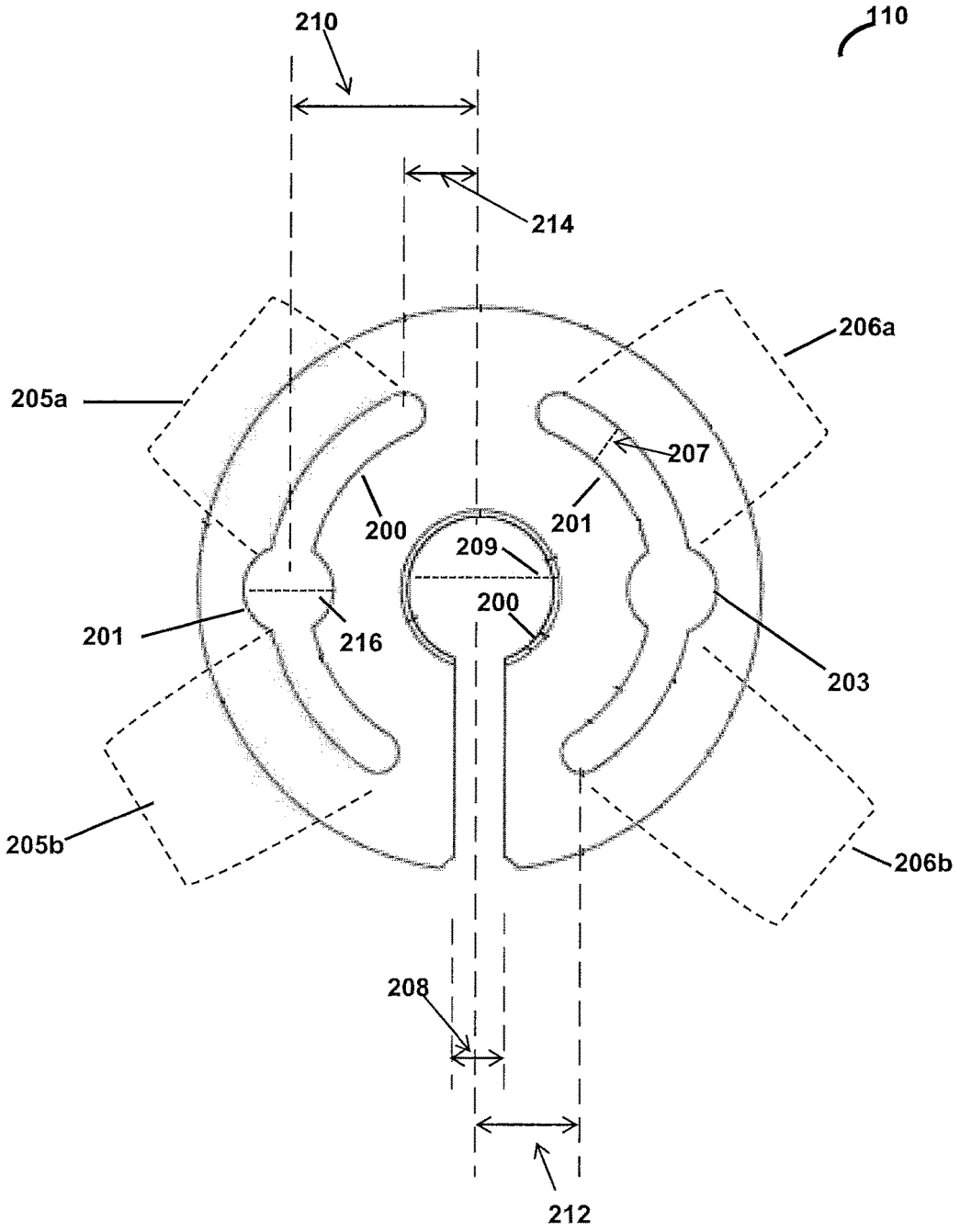
FIG. 2A is a top view of one example of an adjustable plate.

FIG. 2A is a top view of the adjustable plate 110 of FIG. 2. In this example, the adjustable plate 110 can include slots 118, 120, and a threaded portion 200. Each of the slots 118, 120 can include a center portion 201, 203, respectively. In some examples, each of the center portions 201, 203 can have a diameter 216. The diameter 216 may be approximately 0.438 inches. Each of the slots 118, 120 can include distal portions. For example, the slot 118 can include distal portions 205*a-b*. The slot 120 can include distal portions 206*a-b*. In some examples, each of the distal portions 205*a-b*, 306*a-b*, can have a width 207. The width 207 may be approximately 0.20 inches. The width 207 of the distal portions 205*a-b*, 306*a-b* may be smaller than the diameter 216 of the center portions 201, 203. The width 207 being smaller than the diameter 216 may allow fasteners (e.g., the fasteners 114, 115) to be locked within the distal portions 205*a-b*, 306*a-b*, when the adjustable plate 110 is rotated in any direction.

In some examples, the threaded portion 200 of the adjustable plate 110 can have a diameter 209. The diameter 209 can be approximate 0.721 inches. A portion of the diameter 209 can be represented by a distance 208. In some examples, the distance 208 can be approximately 0.250 inches. The adjustable plate 110 may have a distance 210 between the threaded portion 200 and the center portion 201 of the slot 118. In some examples, the distance 210 may be approximately 0.938 inches.

The adjustable plate 110 may have a distance 212 between the threaded portion 200 and a distal portion 206*b* of the slot 120. In some examples, the distance 212 may be 0.500 inches. In some examples, the adjustable plate 110 may have a distance 214 between the threaded portion 200 and a distal portion 205*a* of the slot 118. The distance 214 may be 0.375 inches.

Figure 3:
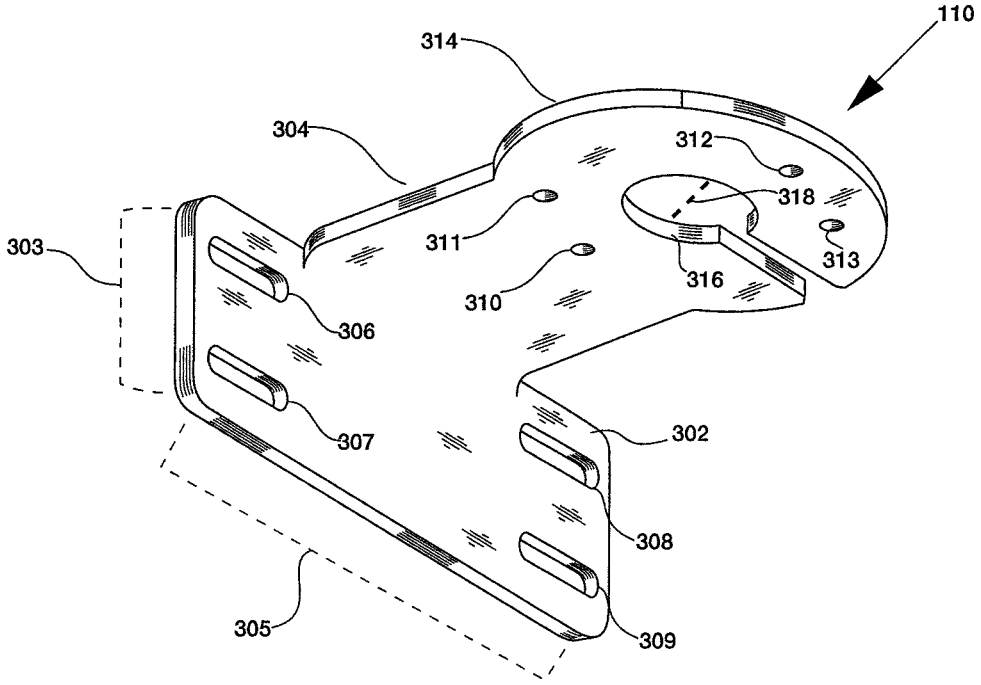
FIG. 3 is a bottom perspective view of one example of a gutter mount.

The adjustable plate 110 can be configured to be coupled to any mount used for attaching a mounting system to a surface of a structure. For example, FIG. 3 is a perspective view of an example of a gutter mount 300 that can be coupled to an adjustable plate.

The gutter mount 300 can be any device that can be used to mount a mounting system (e.g., the mounting system 100) to a surface of a structure (e.g., a building). For example, the gutter mount 300 can be used to mount the mounting system to a fascia board on a building or a rain gutter on a building. In some examples, the gutter mount 300 can be constructed from a number of materials (e.g. aluminum or other metal).

The gutter mount 300 can include a first end 302 and a second end 304. The first end 302 of the gutter mount 300 can be configured to receive fasteners. For example, the first end 302 may include slots 306, 307, 308, 309. In some examples, the slots 306, 307, 308, 309 may be of various shapes, sizes, or orientations. In other examples, the slots 306, 307, 308, 309 may be of substantially the same shape, size, or orientation. Fasteners can be inserted into each of the slots 306, 307, 308, 309. Inserting fasteners into each of the slots 306, 307, 308, 309 may cause the gutter mount 300 to engage with a surface of a structure. For example, screws can be inserted into each of the slots 306, 307, 308, 309. The screws can be screwed through the slots 306, 307, 308, 309 and into the surface for engaging the gutter mount 300 with the surface. Engaging the gutter mount 300 with the surface of the structure may attach a mounting system to the surface.

In this example, the first end 302 includes four slots 306, 307, 308,309. In other examples, the first end 302 may include more than four slots for receiving fasteners. In some examples, the first end 302 may include less than four slots for receiving fasteners. The number of slots can depend on a number of factors including for example, a type of surface that the gutter mount 300 may engage, a size of a fixture to be coupled to the gutter mount 300, the weight of the fixture, and other factors.

In this example, the first end 302 is depicted as being substantially vertical and having a substantially rectangular shape. In some examples, the first end 302 may have a length 303. The length 303 may be approximately 1.5 inches. In some examples, the first end 302 may have a width 305. The width 305 may be approximately 4 inches. In other examples, the first end 302 may be of any configuration, orientation, shape, or size.

The second end 304 of the gutter mount 300 may be configured to receive fasteners. For example, the second end 304 may include other slots 310, 311, 312, 313. The other slots 310, 311, 312, 313 may be configured to receive an object or structure. In some examples, the other slots 310, 311, 312, 313 may be threaded. Threading the other slots 310, 311, 312, 313 may allow the slots 310, 311, 312, 313 to engage with another structure or object having corresponding threads. For example, each of the slots 310, 311, 312, 313 can be threaded to receive a fastener. The fasteners can be inserted into the other slots 310, 311, 312, 313. Inserting the fasteners into the other slots 310, 311, 312, 313 may allow the gutter mount 300 to be coupled to an adjustable plate (e.g., the adjustable plate 110). In this example, the slots 310, 311, 312, 313 may be positioned on a rounded end portion 314 of the second end 304. The rounded end-portion 314 may have a diameter of approximately 2.6 inches. In some examples, the rounded end-portion 314 may allow the gutter mount 300 to be coupled to the adjustable plate. The rounded end-portion 314 may also include a circular center-section 316. The circular center-section 316 may have a diameter 318. The diameter 318 may be approximately 0.875 inches. In some examples the circular center-section 316 may allow the gutter mount 300 to receive a fixture. The fixture may be coupled to the adjustable plate. In other examples, the circular center-section 316 may also be threaded for engaging an externally-threaded end of the fixture.

In this example, the second end 304 includes four slots 310, 311, 312, 313. In other examples, the second end 304 may include more than four slots. In some examples, the second end 304 may include less than four slots. The number of slots included on the second end 304 can depend on a number of factors, including for example, the size of a fixture to be coupled to the gutter mount 300, the weight of the fixture, and other factors.

Figure 4:
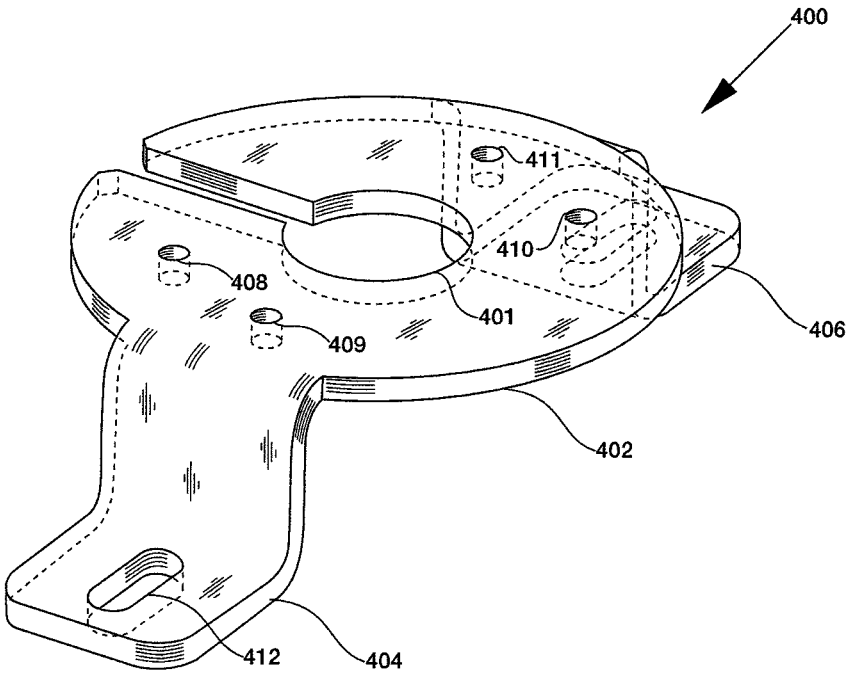
FIG. 4 is a top perspective view of one example of a raised gutter mount.

In some examples, an adjustable plate can be configured to be coupled to other types of mounts. For example, FIG. 4 is a perspective view of an example of a raised surface mount 400 that can be coupled to an adjustable plate.

In this example, the raised surface mount 400 can be any device configured to be coupled to an adjustable plate (e.g., the adjustable plate 110). For example, the raised surface mount 400 can be coupled with the adjustable plate to secure a fixture (e.g., the fixture 106) to a surface of a structure. In some examples, the raised surface mount 400 may be coupled with the adjustable plate to secure a fixture to a tree, arbor, or other similar structure. The raised surface mount 400 may allow a wire associated with the fixture to pass through the raised surface mount 400 via a center-portion 401. The center-portion 401 may allow the wire to pass through and run along a surface of the structure. In some examples, the center-portion 401 may also be threaded for engaging an externally-threaded end of the fixture. In some embodiments, the center-portion 401 may be offset.

The raised surface mount 400 may include a circular top 402 and legs 404, 406. The circular top 402 may include slots 408, 409, 410, 411. In some examples, slots 408, 409, 410, 411 may be of different sizes, shapes, or configurations. In other examples, slots 408, 409, 410, 411 may be of substantially the same size, shape, or configuration. The slots 408, 409, 410, 411 may be configured to receive an object or structure. In some examples, the slots 408, 409, 410, 411 may be threaded. Threading the slots 408, 409, 410, 411 may allow the slots 408, 409, 410, 411 to engage with another object or structure having corresponding threads. For example, each of the slots 408, 409, 410, 411 can be threaded to receive fasteners. The fasteners can be inserted into the slots 408, 409, 410, 411. Inserting the fasteners into the slots 408, 409, 410, 411 may allow the raised surface mount 400 to be coupled to an adjustable plate (e.g., the adjustable plate 110).

In this example, the circular top 402 includes four slots 408, 409, 410, 411. In other examples, the circular top 402 may include more than four slots for receiving fasteners. In some examples, the circular top 402 may include less than four slots for receiving fasteners. The number of slots can depend on a number of factors, including for example, the size of a fixture to be coupled to the raised surface mount 400, the weight of the fixture, and other factors.

The legs 404, 406 of the raised surface mount 400 can be configured to receive fasteners. For example, the leg 404 can include a slot 412. A fastener can be inserted into the slot 412. Inserting the fastener into the slot 412 may cause the raised surface mount 400 to engage with the surface of the structure. For example, a screw can be inserted into the slot 412. The screw can be screwed through the slot 412 and into the surface for engaging the raised surface mount 400 with the surface. Engaging the raised surface mount 400 with the surface of the structure may attach the mounting system to the surface.

In this example, leg 404 includes one slot 412. In other examples, each of the legs 404, 406 may include more than one slot for receiving fasteners. The number of slots on each of the legs 404, 406 can depend on a number of factors including for example, the type of surface that the legs 404, 406 may engage, the size of a fixture to be coupled to the raised surface mount 400, the weight of the fixture, and other factors.

Figure 5:
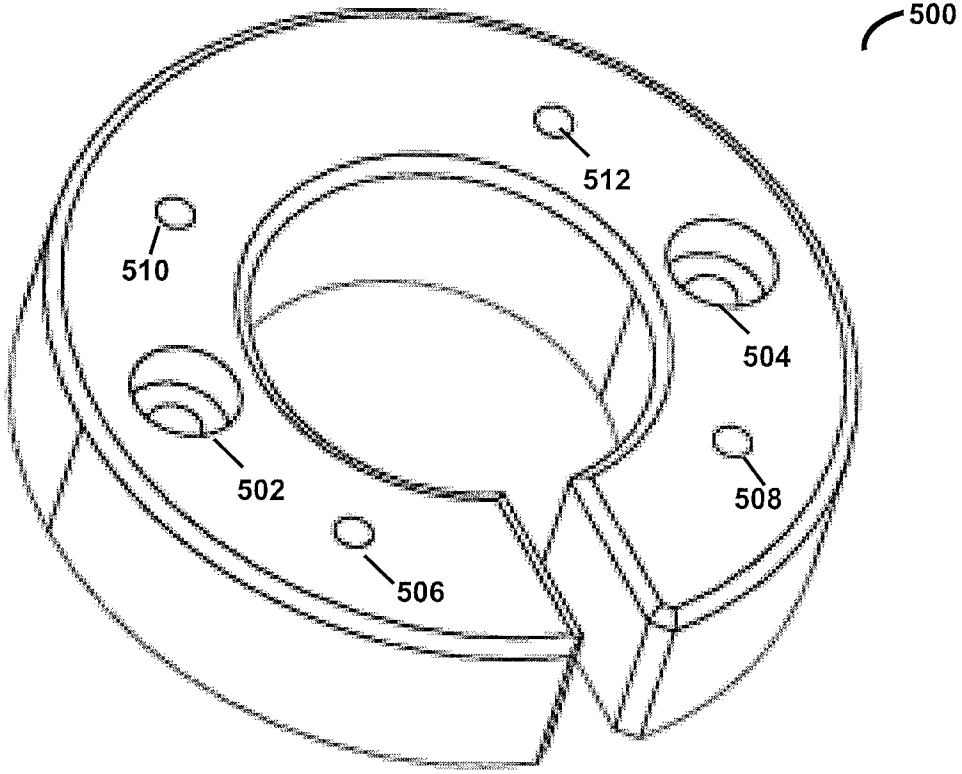
FIG. 5 is a top perspective view of one example of a surface mount.

FIG. 5 is a top view of an example of a surface mount 500 that can be coupled to an adjustable plate. In this example, the surface mount 500 can be any device configured to be coupled with an adjustable plate (e.g., the adjustable plate 110). For example, the surface mount 500 can be coupled with the adjustable plate for securing a fixture (e.g., the fixture 106) to a flat surface of a structure. The surface mount 500 may allow the fixture to be positioned flush against the flat surface. In some examples, the surface mount 500 may allow a wire associated with the fixture to be run under the surface of the structure and through the structure. In some examples, the surface mount 500 may be coupled with the adjustable plate to secure a fixture to a deck, a dock, a patio, or other similar structures.

The surface mount 500 may include slots 502, 504. In some examples, slots 502, 504 may be of different sizes, shapes, or configurations. In other examples, slots 502, 504 may be of substantially the same size, shape, or configuration. The slots 502, 504 may be configured to receive an object or structure. In some examples, the slots 502, 504 may be threaded. Threading the slots 502, 504 may allow the slots 502, 504 to engage with another object or structure having corresponding threads. For example, each of the slots 502, 504 can be threaded to receive fasteners. The fasteners can be inserted into each of the slots 502, 504. Inserting the fasteners into the slots 502, 504 may allow the surface mount 500 to be coupled to an adjustable plate (e.g., the adjustable plate 110).

In this example, the surface mount 500 includes two slots 502, 504. In other examples, the surface mount 500 may include more than two slots for receiving fasteners. The number of slots can depend on a number of factors, including for example, the size of a fixture to be coupled to the surface mount 500, the weight of the fixture, and other factors.

The surface mount 500 may also include other slots 506, 508, 510, 512. In some examples, slots 506, 508, 510, 512 may be of different sizes, shapes, or configurations. In other examples, slots 506, 508, 510, 512 may be of substantially the same size, shape, or configuration. Slots 506, 508, 510, 512 may be configured to receive other fasteners. For example, a drill and anchor can be inserted into each of the slots 506, 508, 510, 512. Inserting the drill and anchor into the slots 5506, 508, 510, 512 may cause the surface mount 500 to engage with the surface of the structure for mounting a mounting system to the surface.

In this example, slots 502, 504 are depicted as having a different size from slots 506, 508, 510, 512. In some examples, the slots 502, 504, 506, 508, 510, 512 may be of substantially the same size, shape, or configuration.

Figure 6:
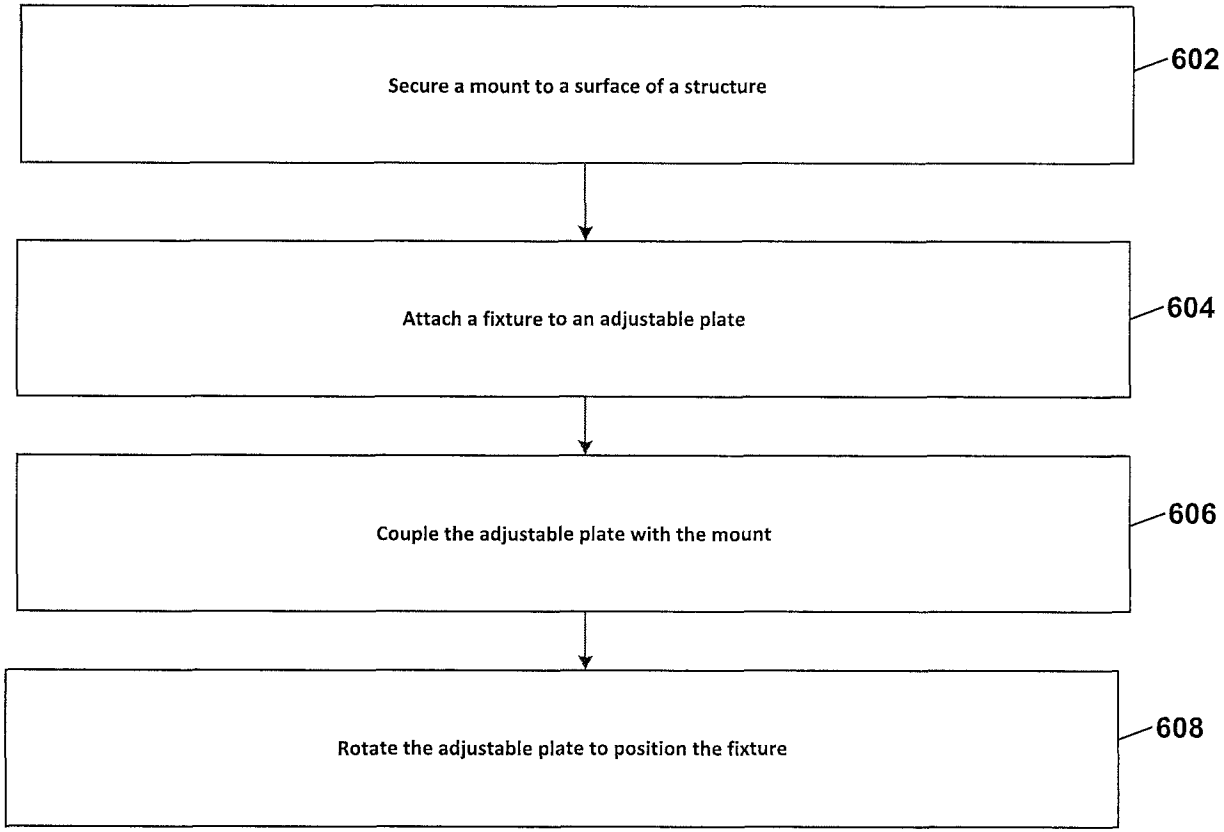
FIG. 6 is a flow chart of a securing method according to one embodiment of the disclosure.

FIG. 6 is a flow chart depicting an example of a process for securing a fixture to a structure using an adjustable plate. In block 602, a mount is secured to a surface of a structure. The mount can be any device configured to engage with the surface of the structure (e.g. a building or property). In some examples, the mount can be configured to receive a fastener (e.g., a bolt, screw, drill and anchor, etc.). The mount can include a slot. The slot may be configured to receive the fastener. Inserting the fastener into the mount may allow the mount to engage with the surface. Engaging the mount with the surface can secure the mount to the surface.

The mount can be of any shape, size, or configuration for engaging with the surface of the structure. The type of mount used to engage the surface can depend on a number of factors including for example, the type of surface, the location of the surface on the structure, and other factors.

In block 604, a fixture is attached to an adjustable plate. The adjustable plate can be any device configured to be coupled to a fixture (e.g., a luminaire or a lighting unit). For example, the adjustable plate can include a threaded portion that is configured to engage an externally-threaded end of the fixture. Engaging the externally-threaded end of the fixture with the threaded portion of the adjustable plate may couple the adjustable plate to the fixture.

In block 606, the adjustable plate is coupled with the mount. In some examples, the adjustable plate can be configured to be coupled to the mount. The adjustable plate can include multiple slots for coupling the adjustable plate to the mount. For example, the adjustable plate can include slots configured to receive fasteners. Each fastener can be any device configured to engage a structure or object with another structure or object (e.g., bolts, screws, magnets, etc.). The fasteners can be attached to a surface of the mount. The adjustable plate can be positioned relative to the mount such that the fasteners can be inserted into the slots on the adjustable plate. Once the fasteners are inserted into the slots, the adjustable plate can be rotated in any direction. In some examples, the slots may be configured to allow the adjustable plate to be rotated after the fasteners are inserted into the slots. Rotating the adjustable plate in any direction may lock the fasteners within the adjustable plate. In another example, the fasteners can be rotated to lock the fasteners within the adjustable plate. Locking the fasteners within the adjustable plate can couple the adjustable plate to the mount.

In other examples, the adjustable plate can be coupled to the mount using magnets. For example, a magnet may be mounted on a surface of the adjustable plate. Another magnet may be mounted on a surface of the mount. The adjustable plate can be positioned relative to magnets on the surface of the mount such that attractive magnetic forces generated by the magnets can cause the adjustable plate and the mount to be coupled.

In block 608, the adjustable plate is rotated to position the fixture. In some examples, the slots on the adjustable plate may allow the adjustable plate to be rotated. The slots may allow the adjustable plate to be rotated while the adjustable plate is coupled to the mount. For example, the slots may be configured such that the adjustable plate can be rotated in any direction after the adjustable plate is coupled to the mount. In some examples, rotating the adjustable plate in any direction may allow the position of the fixture to be adjusted while the adjustable plate and the fixture are coupled to the mount.

In use, particular examples of the mounting system 100 includes a gutter mount, i.e. comprising mount elements shown and described herein, and an adjustable plate. For instance, the gutter mount may be attached to a rain gutter on a building using fasteners that secure the gutter mount to the rain gutter. The adjustable plate may be attached to a fixture (e.g., a light for the building). Once attached to the fixture, for instance a light fixture, the adjustable plate may be attached to the gutter mount to mount the light to the building. As generally illustrated herein, the adjustable plate can include slots that allow the adjustable plate to be attached to the gutter mount. The slots on the adjustable plate allow the adjustable plate to be rotated while the adjustable plate is attached to the gutter mount and while the gutter mount is attached to the rain gutter. Rotating the adjustable plate while the adjustable plate is attached to the gutter can allow the position of the light to be adjusted while the gutter mount is attached to the rain gutter.

As shown, particular embodiments include an adjustable plate that can be used with a mount. A mounting system can be mounted to a surface of a structure (e.g., a building or property) for securing an accessory or fixture (e.g., a luminaire or lighting unit) to the surface of the structure. The mounting system may include an adjustable plate. The adjustable plate can be attached to the fixture. The mounting system can also include a mount. The mount can be used to attach the mounting system to the surface of the structure. The adjustable plate can be attached to the mount and can be used to attach the fixture to the mount. The mount can be used for securing the adjustable plate, along with the fixture, to the surface of the structure. Once the adjustable plate and the fixture are secured to the surface, the adjustable plate can allow the position of the fixture to be adjusted while the mounting system remains attached to the surface.

For example, a mounting system for use with, or as part of, a structure can include a mount (e.g., a gutter mount, a raised mount, or a surface mount) and an adjustable plate. The adjustable plate along with the mount can be used for securing a fixture to a surface of the structure. The adjustable plate can be configured to be coupled to the fixture. The adjustable plate can also be configured to be coupled to the mount. Coupling the adjustable plate to the fixture can allow the adjustable plate, along with the fixture, to be coupled to the mount for securing the fixture to the surface of the structure.

In some examples, the mount can be configured to receive fasteners (e.g., bolts, screws, drills and anchors, etc.) to engage the mount with the surface for mounting the mounting system to the surface. The adjustable plate can include slots configured to receive other fasteners on a surface of the mount. In some examples, the slots on the adjustable plate can be configured to receive the other fasteners on the mount and allow the other fasteners to slide into place within the adjustable plate. After the slots on the adjustable plate receive the other fasteners, the other fasteners can be rotated to couple the adjustable plate to the mount. In other examples, the adjustable plate can be configured such that the adjustable plate, along with the fixture, can be decoupled from the mount while the mount remains mounted to the surface. For example, after the adjustable plate is coupled to the mount, the fasteners can be rotated to decouple the adjustable plate from the mount.

In some examples, the adjustable plate can be configured to be rotated in any direction once the adjustable plate is coupled to the mount. Rotating the adjustable plate once the adjustable plate is coupled to the mount may facilitate adjustment of the fixture after the mounting system is mounted to the surface of the structure. Coupling the adjustable plate to the fixture can facilitate securing the fixture to the surface of the structure. Coupling the adjustable plate to the fixture may also facilitate the adjustment of the fixture while the mounting system is mounted to the surface of the structure.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A mounting system to secure a light fixture with a threaded protruding end about a surface, the system comprising:

a mount having a mounting engagement surface and at least one mounting slot adapted to secure said mount about said surface; and an adjustable plate having a plurality of alignment slots with a threaded center and at least one adjacent distal portion adapted to receive at least one fastener in either said threaded center or said adjacent distal portion, and wherein said adjustable plate adapted to receive said threaded protruding end of said light fixture, and wherein said mount and plate mate in a coupled position, and wherein said plate adapted to be substantially rotational about said mount in said coupled position.

2. The system of claim 1, wherein said adjustable plate includes a central aperture adapted to receive said light fixture.

3. The system of claim 2, wherein said central aperture being a threaded aperture.

4. The system of claim 2, wherein said central aperture includes a slotted electrical communication opening.

5. The system of claim 1, wherein said mount includes a substantially proximate first portion having at least one first end slot.

6. The system of claim 1, wherein said adjustable mount includes a second portion protruding from said first portion, and wherein said second portion separates said first portion and said mounting engagement surface.

7. The system of claim 6, wherein said second portion aligned substantially parallel with said mounting engagement surface.

8. The system of claim 6, wherein said second portion having an angled neck offset with said mounting engagement surface.

9. The system of claim 1, wherein said mounting engagement surface includes a plurality of second portion slots adapted to align about said plate.

10. The system of claim 1, wherein said adjustable plate's alignment slot including an inner area and at least one adjacent distal area.

11. The system of claim 10, wherein said inner area having a diameter greater than a diameter of said distal area.

12. The system of claim 1, further including a light fixture.

13. The system of claim 1, further including a structure surface securing said mounting system.

14. In a mounting system having a mount to secure about a surface and supporting a fixture having a connection end and an opposing illumination end, an adjustable plate comprising:

a central aperture receiving said connection end whereby said illumination end extends away from said plate, and wherein said central aperture having a slotted electrical communication opening; and a plurality of alignment slots having an inner threaded area and a pair of opposing distal areas adapted to receive at least one fastener spaced apart from said central aperture, and wherein said plate adapted to be rotatable in opposing directions about said mount in an adjustable coupled position.

15. The device of claim 14, wherein said inner area having a diameter greater than a diameter of said distal area.

16. The device of claim 14, wherein said central aperture having a plurality of threads adapted to mate with a plurality of corresponding fixture threads.

17. The device of claim 14, wherein said plate being rotational about said mount in said coupled position.

18. A mounting system comprising:

an adjustable mount having a threaded central aperture and a plurality of mounting slots, and wherein said central aperture includes a slotted electrical communication opening; and an adjustable plate including a central aperture having a slotted electrical communication opening, and a plurality of alignment slots having a threaded center and at least one adjacent distal portion adapted to receive at least one fastener in said threaded center and said adjacent distal portion.

19. The system of claim 18, wherein said threaded center having a diameter greater than a diameter of said distal portion.

20. The system of claim 18, wherein said mount and plate mate in a rotational coupled position, and wherein said plate adapted to be substantially rotational in at least two directions about said mount in said coupled position.

* * * * *